US006362577B1

(12) United States Patent
Ito et al.

(10) Patent No.: US 6,362,577 B1
(45) Date of Patent: Mar. 26, 2002

(54) DISCHARGE LAMP LIGHTING CIRCUIT

(75) Inventors: Masayasu Ito; Hitoshi Takeda, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/596,180

(22) Filed: Jun. 16, 2000

(30) Foreign Application Priority Data

Jun. 21, 1999 (JP) ..... 11-174373

(51) Int. Cl.[7] ..... H05B 37/00

(52) U.S. Cl. ..... 315/289; 315/290; 315/278; 315/291; 315/315

(58) Field of Search ..... 315/209 R, 206, 315/208, 201, 240, 289, 290, 252, 257, 278, 291, 307, 312, 315, 324, 82

(56) References Cited

U.S. PATENT DOCUMENTS 3,919,595 A 11/1975 Willis, Jr. ..... 315/257
4,132,925 A 1/1979 Schmutzer et al. ..... 315/208
5,068,570 A * 11/1991 Oda et al. ..... 315/128
5,212,428 A * 5/1993 Sasaki et al. ..... 315/308
5,486,740 A 1/1996 Yamashita et al. ..... 315/308
5,568,017 A 10/1996 Albou ..... 315/219
6,057,650 A * 5/2000 Betz et al. ..... 315/289

FOREIGN PATENT DOCUMENTS

JP 6-283284 7/1994

* cited by examiner

*Primary Examiner*—Haissa Philogene
(74) *Attorney, Agent, or Firm*—Fish & Richardson P.C.

(57) ABSTRACT

In a discharge lamp lighting circuit 1 using a common starter circuit 5A to a plurality of discharge lamps 6*i* (i=1, 2, . . . , n) to start the discharge lamps 6, the starter circuit 5A has a transformer 7 comprising a plurality of secondary windings 7*bi* (i=1, 2, . . . , n) provided for a primary winding 7*a*. A primary circuit 8 comprises a capacitor 9 and a switch element 10 and the generated voltage when the capacitor 9 is charged when the switch element 10 conducts is increased by the transformer 7, then is applied through each secondary winding to the corresponding discharge lamp.

9 Claims, 7 Drawing Sheets

DISCHARGE LAMP LIGHTING CIRCUIT

BACKGROUND OF THE INVENTION

This invention relates to a discharge lamp lighting circuit using a common starter circuit to a plurality of discharge lamps to start the discharge lamps.

The configuration of a lighting circuit of a discharge lamp, such as a metal halide lamp, comprising a DC power supply circuit, a DC-AC conversion circuit, and a starter circuit is known, for example.

As the configuration of the starter circuit, a capacitor and a switch element are provided for a primary winding of a transformer and a high-voltage start (pulse) signal is applied to a discharge lamp via a secondary winding of the transformer. That is, when terminal voltage reaches a threshold value as the capacitor in the primary circuit is charged, the switch element conducts (or breaks down) and the generated voltage at this time is increased by the transformer and is supplied to the discharge lamp as a start signal (so-called starter pulse), causing the discharge lamp to break down.

By the way, to light a plurality of discharge lamps by the lighting circuit in the related art, the starter circuits are provided in a one-to-one correspondence with the discharge lamps, thus causing costs to rise and a unit to be upsized; this is a problem.

For example, to use a discharge lamp as a light source of a car's front light, if a front light is attached to each of the left and the right of the front of the vehicle, two left and right discharge lamps and their respective lighting circuits become necessary. To adopt a configuration wherein high and low beams are provided by separate discharge lamps (so-called four-light illumination), two left and two right discharge lamps and their respective lighting circuits are required. In such a case, if as many separate starter circuits as the number of the discharge lamps are provided, costs are increased and in addition, as a unit is upsized, it becomes difficult to provide a circuit unit placement space.

SUMMARY OF THE INVENTION

It is therefore an object of the invention to reduce costs and miniaturize a unit by providing a common starter circuit to a plurality of discharge lamps.

To the end, according to the invention, there is provided a discharge lamp lighting circuit using a common starter circuit to a plurality of discharge lamps to start the discharge lamps. In the discharge lamp lighting circuit, (a) the starter circuit has a transformer comprising a plurality of secondary windings provided for one primary winding, the secondary windings being connected to the discharge lamps in a one-to-one correspondence; and (b) a primary circuit containing the primary winding of the transformer comprises a capacitor and a switch element and when the switch element conducts (or breaks down), the capacitor is discharged and the generated voltage at this time is increased by the transformer, then is applied through each secondary winding to the corresponding discharge lamp.

According to the invention, the transformer implementing the starter circuit comprises a plurality of secondary windings provided for one primary winding and a start signal is applied from each secondary winding to the corresponding discharge lamp, so that the starter circuit can be used in common to a plurality of discharge lamps.

DETAILED DESCRIPTION OF THE PREFERRED EMBODIMENTS

Figure 1:
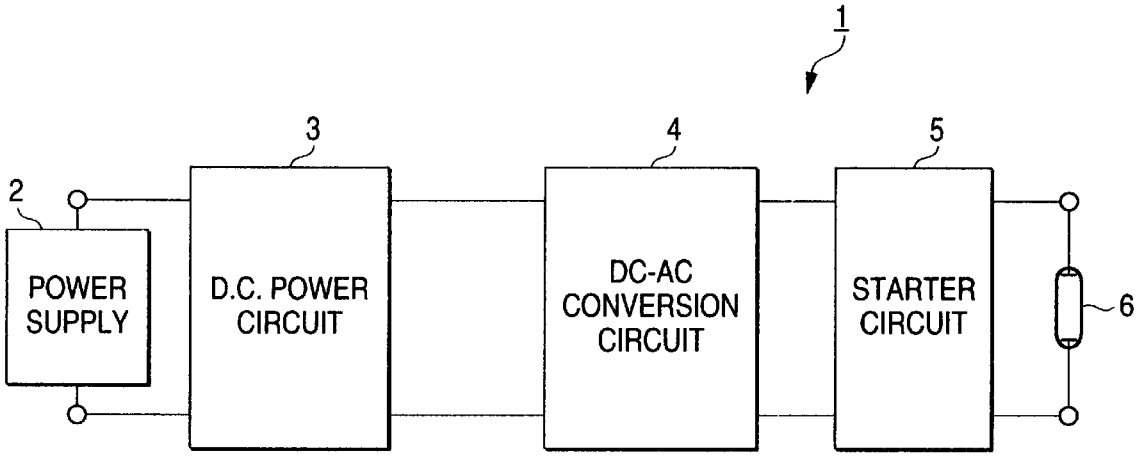
FIG. 1 is a circuit block diagram to show the basic configuration of a discharge lamp lighting circuit according to the invention.

FIG. 1 shows the basic configuration of a discharge lamp lighting circuit according to the invention; it shows the circuit configuration concerning one discharge lamp (only a feed system except a control system).

A discharge lamp lighting circuit 1 comprises a power supply 1, a DC power supply circuit 3, a DC-AC conversion circuit 4, and a starter circuit 5.

The DC power supply circuit 3 is provided for controlling lighting of a discharge lamp 6 based on AC or DC power supply voltage supplied from the power supply 2. For example, to input DC, DC-DC converters each having the configuration of a switching regulator (chopper type, flyback type, etc.,) are used.

The DC-AC conversion circuit 4 is provided for converting the output voltage of the DC power supply circuit 3 into AC voltage and supplying the AC voltage to the discharge lamp 6. For example, a bridge-type circuit configuration wherein four semiconductor switch elements are grouped into two pairs and switching control is performed reciprocally is adopted.

The starter circuit 5 is provided for generating a start signal (high voltage pulse) for the discharge lamp 6 for starting the discharge lamp 6. The start signal is superposed on AC voltage output by the DC-AC conversion circuit 4 and is applied to the discharge lamp 6.

Figure 2:
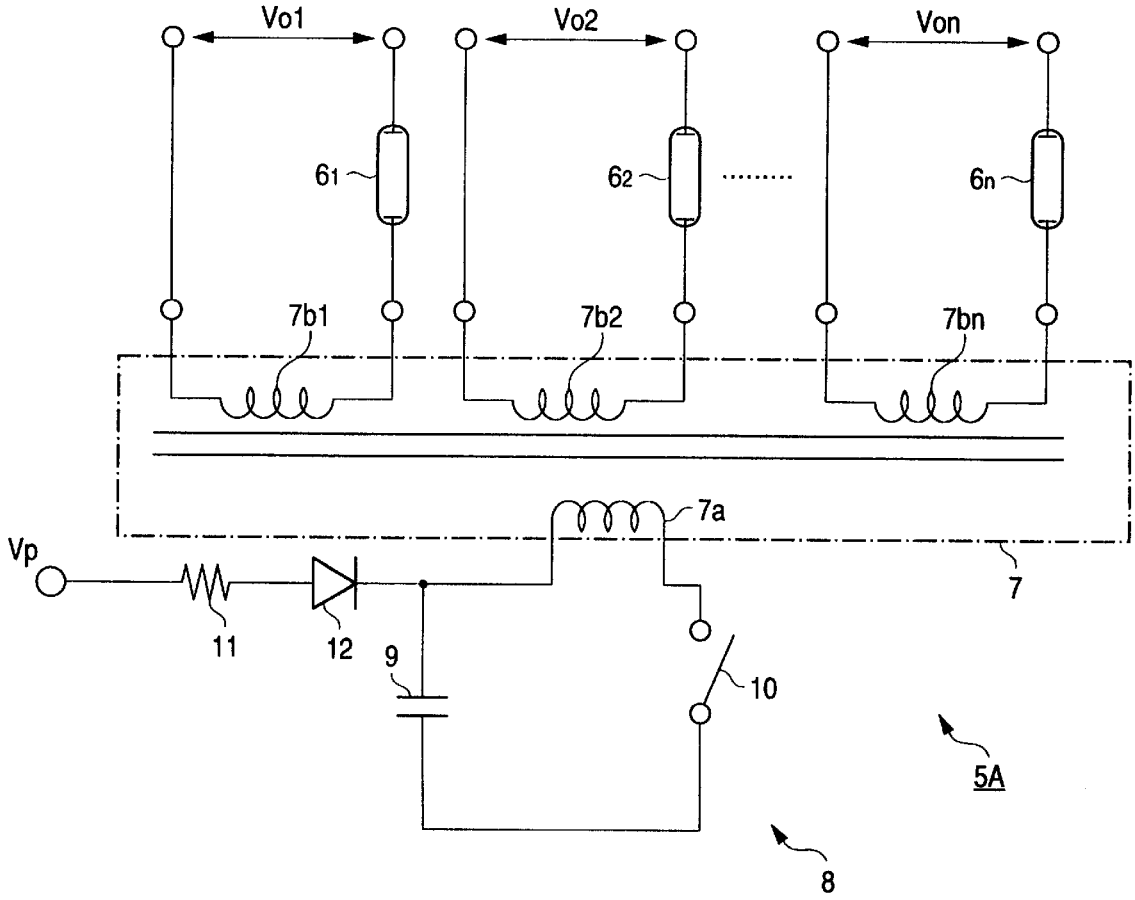
FIG. 2 is a circuit diagram to show the basic configuration of a starter circuit for lighting a plurality of discharge lamps.

FIG. 2 shows the basic configuration of a starter circuit 5A common to a plurality of discharge lamps 6*i* (i=1, 2, . . . , n where n is a natural number) for lighting the discharge lamps.

A transformer 7 in the starter circuit 5A comprises a plurality of secondary windings 7*bi* (i=1, 2, . . . , n) provided for one primary winding, and the secondary windings are connected to the discharge lamps 6*i* in a one-to-one correspondence. For example, the discharge lamp 61 is connected in series to the secondary winding 7*b*1 and output voltage Vo1 from the DC-AC conversion circuit (not shown) is supplied to them. That is, the above-mentioned lighting circuit (except the starter circuit 5A) is provided for each discharge lamp 6*i* and to the discharge lamp 6*i* connected in series to the secondary winding 7*bi*, output voltage Voi (i=1, 2, . . . , n) is supplied from the corresponding DC-AC conversion circuit 4.

A primary circuit 8 containing the primary winding 7*a* of the transformer 7 comprises a capacitor 9 and a switch element 10 (simply indicated by a switch symbol in the figure; a discharge gap element, a thyristor, a triac, etc., is used). When the switch element 10 conducts (or breaks down), the capacitor 9 is discharged and the generated voltage at this time is increased by the transformer 7, then is applied to the discharge lamp 6*i* through the secondary winding 7*bi*. For example, primary voltage Vp is supplied to the capacitor CS via a resistor 11 and a forward diode 12, whereby the capacitor 9 is charged and when the terminal voltage of the capacitor 9 reaches a predetermined threshold voltage, the switch element 10 operates and the capacitor 9 is discharged, so that voltage is generated on the primary winding 7*a*.

For example, the following supply methods of the primary voltage vp are available, any of which may be used in the invention:

(I) Method of providing the primary voltage from output voltage of the DC power supply circuit or the DC-AC conversion circuit;

(II) method of providing the primary voltage by increasing output voltage of the DC power supply circuit or the DC-AC conversion circuit through a voltage doubler circuit, etc.,;

(III) method of providing the primary voltage by adding a winding to the secondary side of a converter transformer placed in the DC power supply circuit and rectifying and smoothing output of the secondary winding.

Preferably, the winding beginnings (or winding terminations) of the secondary windings 7*bi* of the transformer 7 are defined as the connection terminal sides to the discharge lamps, namely the connection relationship is unified with respect to the discharge lamps.

The reason is to prevent the following disadvantages:

(1) The polarities of the start signals to the discharge lamps are not unified;

(2) the supply directions of primary energy become irregular;

(3) the discharge lamp easily goes out at the polarity switching time after the discharge lamp is lighted.

These will be discussed briefly with reference to FIGS. 3 to 5.

Figure 3:
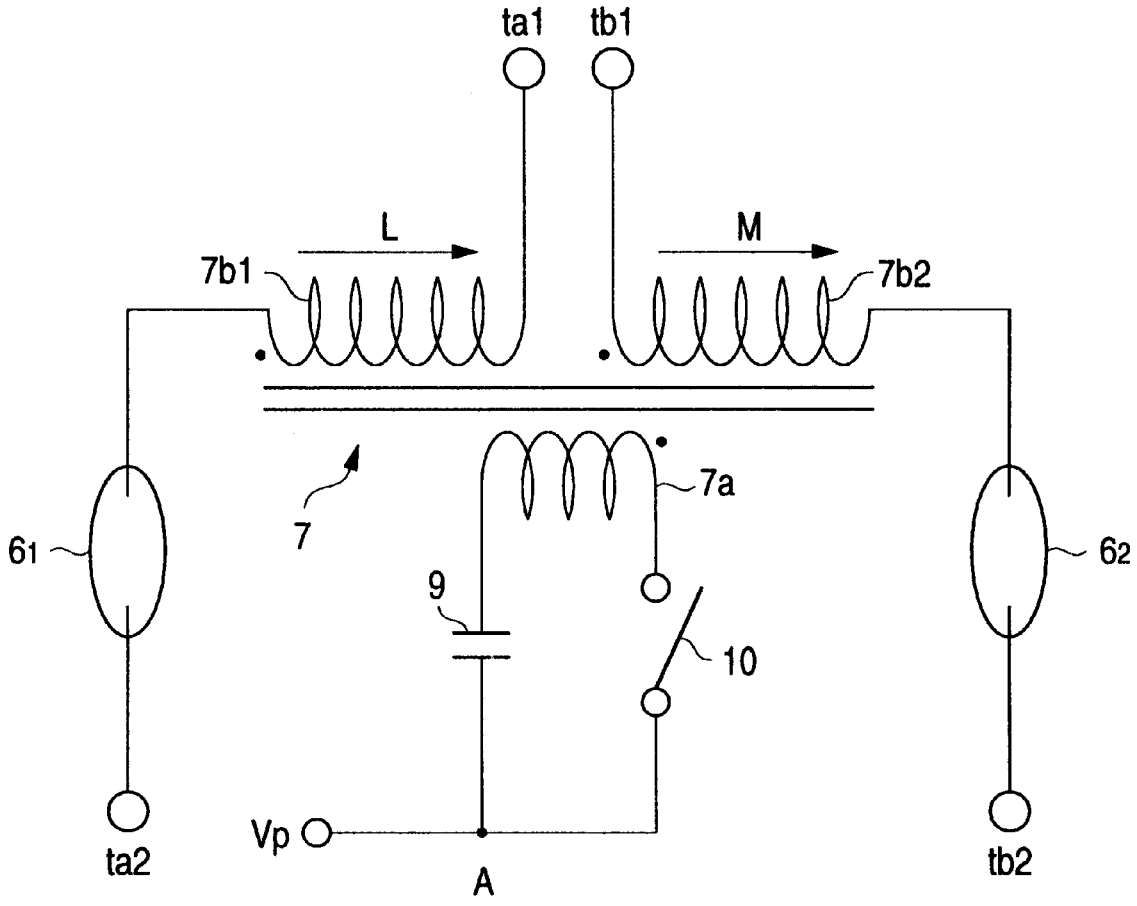
FIG. 3 is a diagram to describe the connection relationships between secondary windings of a transformer and discharge lamps together with FIGS. 4 and 5; it is a circuit diagram to show a configuration example involving a problem.

FIG. 3 shows the main part of the circuit configuration for lighting the two discharge lamps 61 and 62, wherein two secondary windings 7*b*1 and 7*b*2 are provided on the secondary side of the transformer 7.

In the figure, output voltage Vol from the DC-AC conversion circuit (not shown) is supplied to terminals ta1 and ta2. The terminal on the side of the winding beginning (indicated by the "." mark in the figure) in the secondary winding 7*b*1 of the transformer 7 (start end) is connected to the discharge lamp 61 and is connected through the discharge lamp 61 to the terminal ta2, and the terminal on the winding end side in the secondary winding 7*b*1 (termination) is connected to the terminal ta1. Output voltage Vo2 from the DC-AC conversion circuit (not shown) is supplied to terminals tb1 and tb2. The terminal on the side of the winding beginning (indicated by the "." mark in the figure) in the secondary winding 7*b*2 of the transformer 7 (start end) is connected to the terminal tb1, and the terminal on the winding end side in the secondary winding 7*b*2 (termination) is connected to the discharge lamp 62 and is connected through the discharge lamp 62 to the terminal tb2. That is, to prepare the transformer, winding a coil is started at one end of a core and the terminal is taken out at the center, then the coil is wound around the core from the center to an opposite end.

In the primary circuit of the transformer 7, the switch element 10 is connected to the terminal on the side of the winding beginning (indicated by the "." mark in the figure) in the primary winding 7*a* (start end), and a capacitor 9 is connected to the terminal on the winding end side in the primary winding 7*a* (termination). The primary voltage Vp is supplied to a connection point A of the switch element 10 and the capacitor 9.

In the circuit, assuming that a positive-polarity start pulse (start signal) is applied to one discharge lamp (for example, the discharge lamp 62), a negative-polarity start pulse is applied to the other discharge lamp. (This is the item (1) mentioned above.) That is, when starting the discharge lamps is only considered, the irregular polarities do not introduce a problem, but large withstand voltage is required in design of the transformer and therefore such a configuration is not preferred.

The primary energy in (2) mentioned above (the energy accumulated in the capacitor 9 in the primary circuit appears as an electric current flowing into the primary winding 7*a* as the capacitor 9 is discharged when the switch element 10 is operated, and then is converted as output of the secondary winding) becomes opposite direction on each secondary winding, for example, as indicated by arrows L and M in FIG. 3 (the opposite direction to the direction approaching the discharge lamp 61 as indicated by the arrow L on the secondary winding 7*b*1 and the direction toward the discharge lamp 62 as indicated by the arrow M on the secondary winding 7*b*2). Therefore, the polarity of the output voltage of the DC-AC conversion circuit must be made opposite to the polarity for a different discharge lamp depending on the discharge lamp because if the polarity of the output voltage is set to a constant polarity, the transition to the light state after the discharge lamp breaks down is easily made. Thus, a cumbersome circuit configuration is involved.

The item (3) mentioned above is caused by the fact that the action for blocking polarity switch for supply voltage related to the discharge lamp occurs because of electromagnetic coupling between the two secondary windings.

That is, it is known that re-striking auxiliary potential occurs at the polarity switching time; when the polarity is switched, the energy caused by the electric current flowing into the secondary winding of the transformer until just before the polarity is switched accumulates in the capacitance component of the transformer and becomes voltage. Since the voltage is applied to the discharge lamp via the secondary inductance of the transformer, the polarity is easily inverted as the voltage becomes higher.

Figure 4:
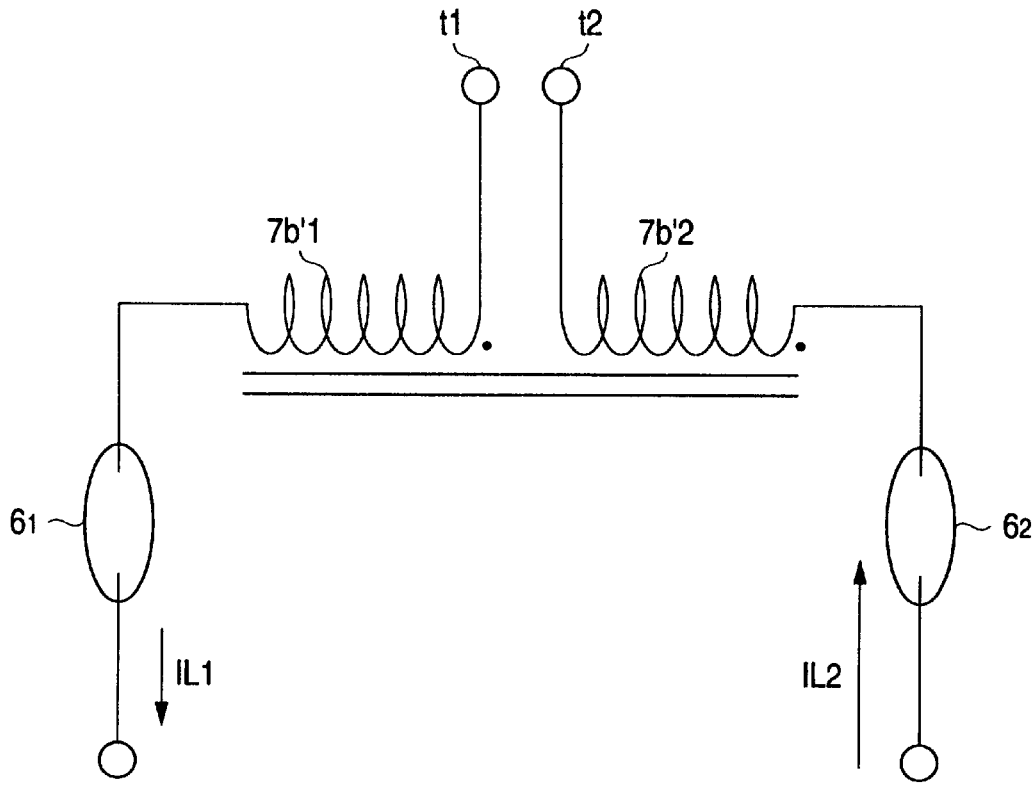
FIG. 4 is a diagram to describe the effect of re-striking auxiliary potential occurring at the polarity switching time on another secondary winding together with FIG. 5; it is a schematic circuit diagram to show the main part.

FIG. 4 shows a secondary winding 7*b*'1 of the transformer 7 connected to the discharge lamp 61 (the winding beginning of the secondary winding 7*b*'1 is connected to a voltage supply terminal t1 and the winding termination is connected to the discharge lamp 61) and a secondary winding 7*b*'2 of the transformer 7 connected to the discharge lamp 62 (the winding beginning of the secondary winding 7*b*'2 is connected to the discharge lamp 62 and the winding termination is connected to a voltage supply terminal t2); the primary circuit is not shown. The output voltage from the DC-AC conversion circuit (not shown) is supplied to the terminals t1 and t2.

Now, assume that a positive-polarity voltage (or positive voltage in square wave) is supplied to the discharge lamp 61 and the discharge lamp 61 is steadily lighted and that the discharge lamp 62 is just lighted and a negative- polarity voltage (or negative voltage in square wave) is supplied to the discharge lamp 62 and power over the rated power is supplied thereto. In the figure, the electric currents flowing into the discharge lamps 61 and 62 are denoted by IL1 and IL2 respectively.

If the polarity is inverted in this state, namely, if the positive polarity is inverted to the negative polarity for the discharge lamp 61 and the negative polarity is inverted to the positive polarity for the discharge lamp 62, immediately re-striking auxiliary potential occurs on the winding termination side of the secondary winding 7*b*'2 on the discharge lamp 62 side. Since the secondary windings 7*b*'2 and 7*b*'1 are electromagnetically coupled, the effect of the re-striking auxiliary potential also appears on the secondary winding 7*b*'1. That is, although the discharge lamp 61 attempts to switch to the negative polarity, high voltage is supplied because of the electromagnetic coupling and the action blocking the polarity switch is exerted.

Figure 5:
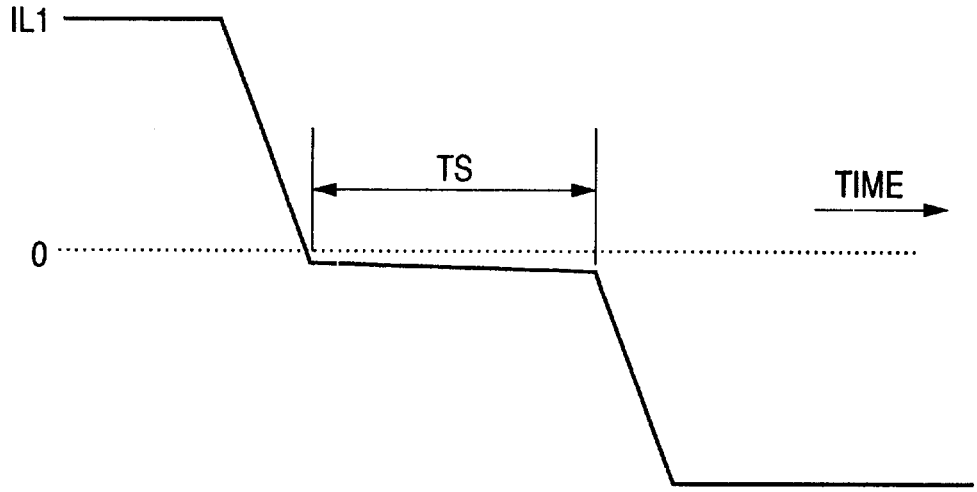
FIG. 5 is a waveform chart to conceptually show electric current flowing into a discharge lamp.

FIG. 5 is a waveform chart to conceptually show the state; it shows the positive-to-negative polarity transition for change in the current IL1 to the discharge lamp 61 with time.

As seen in FIG. 5, a period occurs in which the current IL1 stays in the vicinity of zero A (ampere) when the polarity is switched (see TS in the figure). The larger the current to the discharge lamp 62, the larger the re-striking auxiliary potential, and thus the phenomenon appears remarkably.

Figure 6:
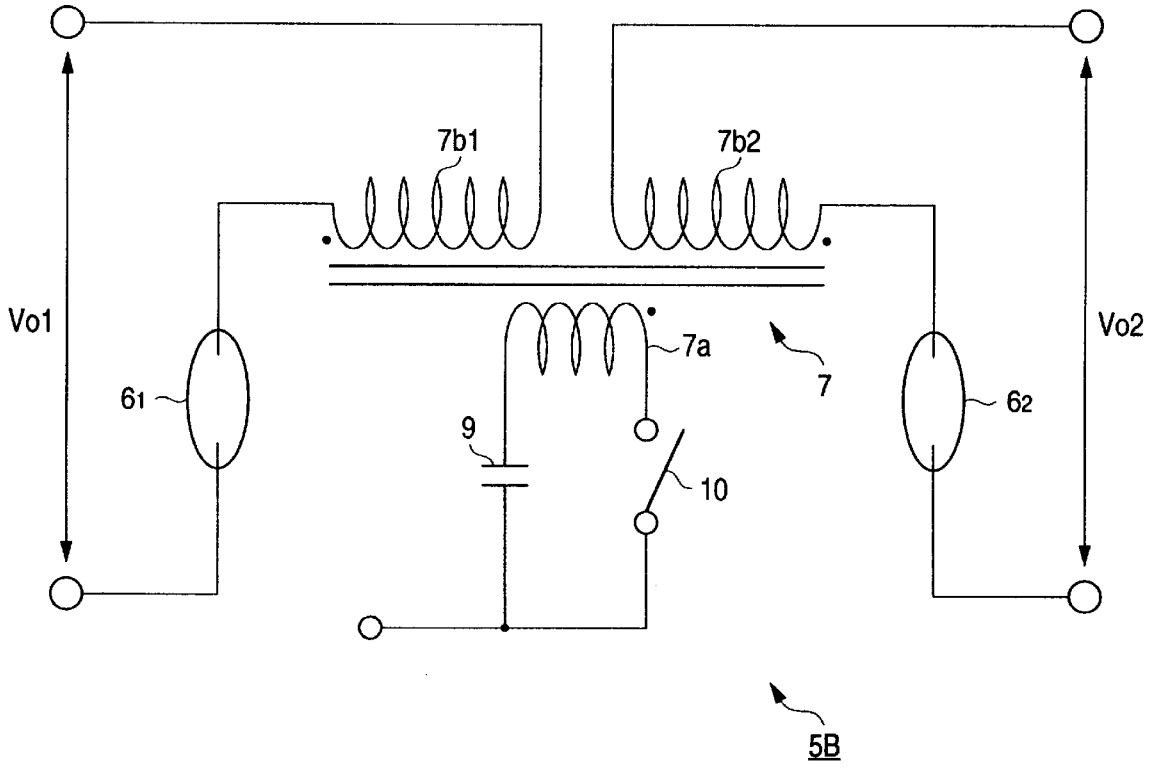
FIG. 6 is a drawing to described preferred connection relationships between secondary windings and discharge lamps.

Therefore, to eliminate the evil effects of (1) to (3) mentioned above, the configuration of a starter circuit 5B, for example, shown in FIG. 6 is preferred. That is, to use the two discharge lamps 61 and 62, the winding beginning ends of the secondary windings 7*b*1 and 7*b*2 of the transformer 7 connected to the discharge lamps 61 and 62 may be connected to the discharge lamps 61 and 62 and the winding terminations may be connected to the DC-AC conversion circuit output terminals. In FIG. 6, it is clear that the winding terminations of the secondary windings 7*b*1 and 7*b*2 may be connected to the discharge lamps 61 and 62 (the "." marks may be thought of as the winding ends) from the fact that the winding beginning and termination of a coil are a relative concept. For example, when two windings are around a single magnetic substance, if one end of one winding is defined as the winding beginning, the winding beginning end and termination of the other winding can be defined. Therefore, if the definition for the winding beginning and termination of the coil is reversed, no problem occurs if the connection relationships between the coils (the secondary windings) and the discharge lamps are always unified.

According to the invention, the voltage induced on the primary winding 7*a* of the transformer 7 is applied via each secondary winding 7*bi* (i=1, 2, . . . , n) to each discharge lamp 6*i* (i=1, 2, . . . , n), whereby the corresponding discharge lamp is started.

For example, to light both the discharge lamps 61 and 62 at the same time from the state in which the discharge lamps are out, similar start (pulse) signals are applied to the discharge lamps, so that the discharge lamps can be started at the same time (or almost the same time). If one discharge lamp 61 is lighted without a problem and lighting the other discharge lamp 62 ends in failure, again the start signal is generated for starting the latter discharge lamp 62, whereby the discharge lamp can be lighted. At the time, the start signal is also applied to the lighted discharge lamp 61. However, since the impedance of the discharge lamp at the lighting time is low, the generated voltage is attenuated immediately and thus has no effect. On the other hand, the voltage generated on the secondary winding 7*b*2 connected to the discharge lamp 62 not lighted is a high-frequency voltage, so that the planned start signal is applied to the discharge lamp 62 with little receiving the effect of voltage attenuation on the secondary winding 7*b*1 connected to the discharge lamp 61.

Figure 7:
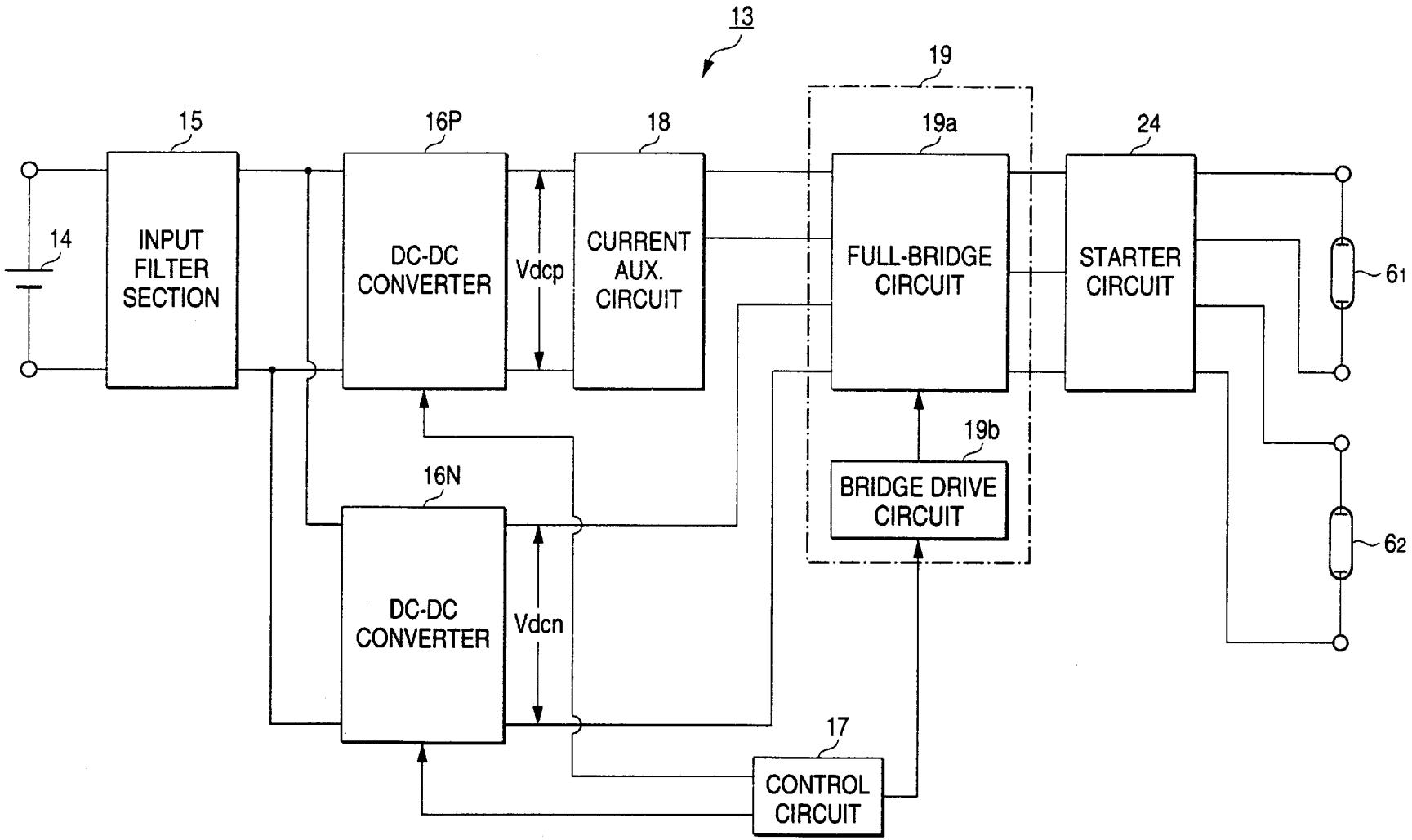
FIG. 7 is a diagram to show one embodiment of the invention together with FIG. 8; it is a circuit block diagram to show a general configuration.
Figure 8:
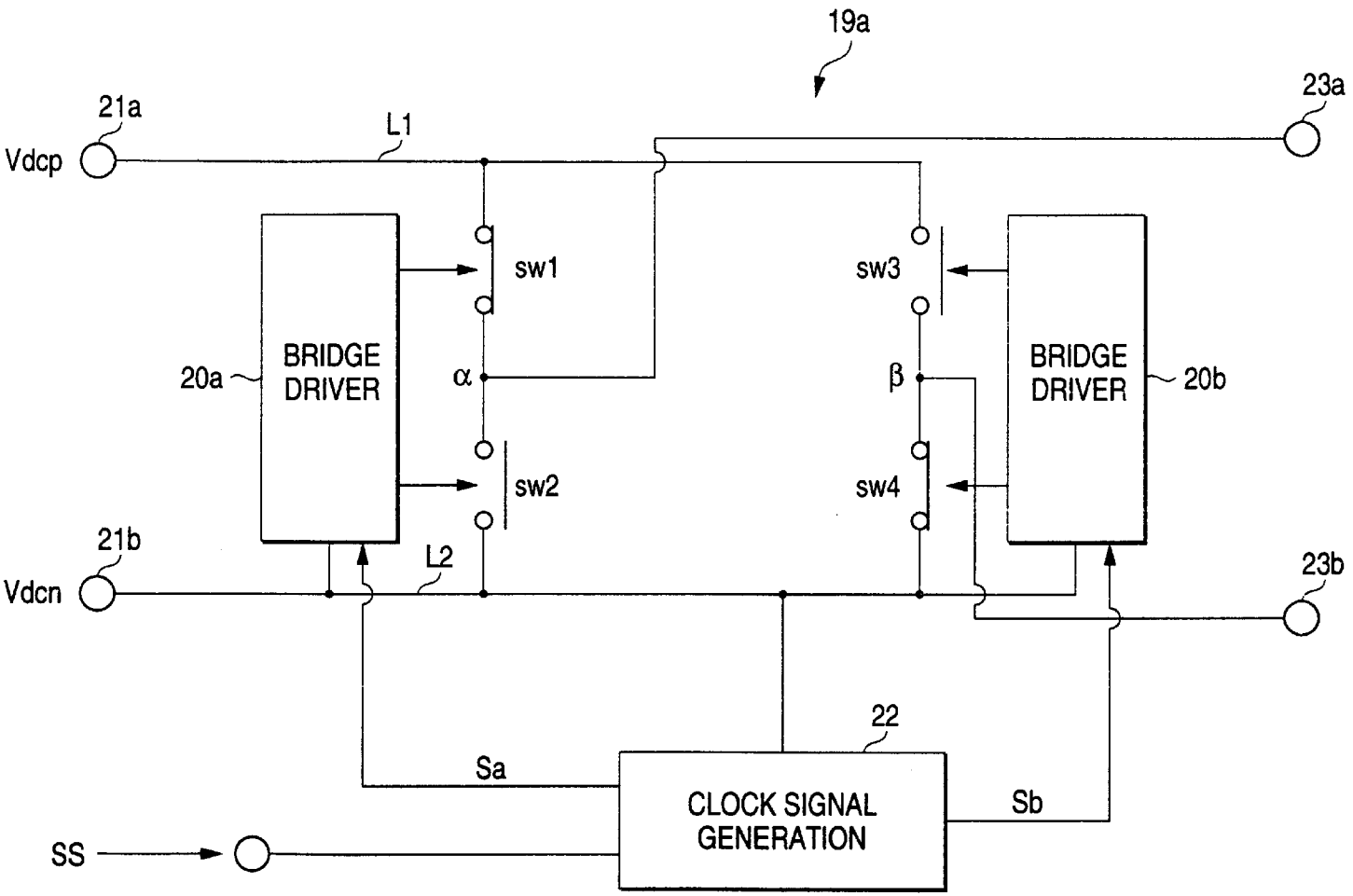
FIG. 8 is a diagram to show a configuration example of a DC-AC converter.

FIGS. 7 and 8 show another embodiment of the invention; they shows an application example to car's front lights (circuit configuration example to use two discharge lamps).

In a lighting circuit 13 shown in FIG. 7, terminal voltage of a battery 14 is supplied through an input filter section 15 to a DC-DC converter 16P for positive-polarity voltage output and a DC-DC converter 16N for negative-polarity voltage output.

A control circuit 17 is provided for the DC-DC converters to control output voltages thereof, and control signals issued by the control circuit 17 are sent to the DC-DC converters for controlling turning on/off switching elements in the converter. The control circuit 17 controls power supply to the discharge lamps based on detection signals of tube voltage and tube current of each discharge lamp or their equivalent signals.

The DC-DC converter 16P is followed by a current auxiliary circuit 18 for aiding in reliably making the transition from glow discharge to arc discharge by supplying energy accumulated in a capacitive load provided in the current auxiliary circuit 18 to the discharge lamp when the discharge lamp is started.

A DC-AC converter 19 consists of a full-bridge type circuit 19*a* and a bridge drive circuit 19*b*, and corresponds to the DC-AC conversion circuit 4 mentioned above. That is, four semiconductor switch elements are provided in the full-bridge type circuit 19*a* and are grouped into two pairs and switching control is performed reciprocally, whereby DC input voltage is converted into square wave voltage. For this purpose, the bridge drive circuit 19*b* generates control signals to the switch elements; it operates upon reception of a signal sent from the control circuit 17.

FIG. 8 shows a configuration example of the full-bridge type circuit 19*a* and the bridge drive circuit 19*b*.

For four 3-terminal switch elements sw1, sw2, sw3, and sw4 (equivalently shown simply using switch symbols in the figure although field-effect transistors, for example, are used as the switch elements), sw1 and sw4 and sw2 and sw3 are paired and operate upon reception of control signals from bridge drivers 20*a* and 20*b*.

One of DC input terminals 21*a* and 21*b*, 21*a*, is connected to a line L1 and output voltage of the DC-DC converter 16P, Vdcp, is supplied thereto. The other 21*b* is connected to a line L2 and output voltage of the DC-DC converter 16N, Vdcn, is supplied thereto.

The switch element sw1 has two non-control terminals, one connected to the line L1 and the other connected to the line L2 via the switch terminal sw2. A control signal from the bridge driver 20*a* is supplied to control terminals of the switch elements sw1 and sw2.

The switch element sw3 has two non-control terminals, one connected to the line L1 and the other connected to the line L2 via the switch terminal sw4. A control signal from the bridge driver 20*b* is supplied to control terminals of the switch elements sw3 and sw4.

A clock signal generation circuit (clock isolator) receives a control signal SS from the control circuit 17 and converts the level of the signal, then generates a clock signal (for example, a square wave signal of about 500 Hz) and outputs the clock signal to the bridge driver 20*a* or 20*b*. The control signal SS is asignal for polarity switch concerning supply voltage to the discharge lamps (polarity switch control signal).

If a signal Sa sent from the clock signal generation section 21 to the bridge driver 20*a* is, for example, high, the bridge driver 20*a* defines the state of each element so as to turn on the switch element sw1 and turn off the switch element sw2. At this time, a signal Sb sent from the clock signal generation section 21 to the bridge driver 20*b* is low, thus the bridge driver 20*b* defines the state of each element so as to turn off the switch element sw3 and turn on the switch element sw4. If the signal Sa is low (the signal Sb is high), the state of each switch element is reversed. Thus, the switch elements sw1 and sw4 are placed in the same state and the switch elements sw2 and sw3 are placed in the same state and the switch elements alternately operate reciprocally.

Supply voltage to the discharge lamp 61 is taken out through an output terminal 23*a* from a connection point a of the switch elements sw1 and sw2, and supply voltage to the discharge lamp 62 is taken out through an output terminal 23*b* from a connection point β of the switch elements sw3 and sw4.

A starter circuit 24 is provided in common to the two discharge lamps 61 and 62 at the stage following the DC-AC converter 19. The discharge lamps 61 and 62 may be used as light sources of front lights placed on the left and right of the front of a vehicle respectively or may be used as light sources of a high beam and a low beam respectively (in this case, control is required so as not to light the unused discharge lamp in response to beam change).

The configuration of the starter circuit 24 is almost as shown in FIG. 6 and therefore will not be discussed again in detail. In the embodiment, a spark gap element is used as a switching element. This means that the voltage generated by the discharge current of a capacitor when the element breaks down is applied to the discharge lamp through a secondary winding. The terminal of each discharge lamp opposite to the terminal connected to the secondary winding is grounded via a current detection resistor (shunt resistor).

To light only one discharge lamp 61 from the state in which both the discharge lamps 61 and 62 are out, the on/off state of each switch element in the full-bridge type circuit 19*a* is defined so as to supply positive-polarity voltage to the discharge lamp 61 and supply voltage Vdcp to the discharge lamp 61 in the period is raised to the level required for the DC-DC converter 16P (Vovc), then a start signal is generated for starting the discharge lamp 61. Likewise, to light only the other discharge lamp 62, the on/off state of each switch element (sw1 to sw4) in the full-bridge type circuit 19*a* is defined so as to supply positive-polarity voltage to the discharge lamp 62 and supply voltage Vdcp to the discharge lamp 62 in the period is raised to the level required for the DC-DC converter 16P, then a start signal is generated for starting the discharge lamp 62. Such a control sequence is adopted, whereby the current auxiliary circuit 18 needs to be provided only at the stage following the DC-DC converter 16P, so that the circuit configuration is simplified.

As seen from the description made above, according to the invention, the transformer implementing the starter circuit comprises a plurality of secondary windings provided for one primary winding and a start signal is applied from each secondary winding to the corresponding discharge lamp, so that the starter circuit can be used in common to a plurality of discharge lamps. Therefore, the costs can be reduced, a unit can be miniaturized, and the required space can be saved.

Further, the winding beginnings or winding terminations of all secondary windings involved in the transformer are always defined as the connection terminal sides to the discharge lamps, whereby the design withstand voltage problem of the transformer caused by that fact that the polarities of the start signals to the discharge lamps are not unified is solved, and the evil effect caused by the fact that the supply directions of the primary energy become irregular and the disadvantage that the discharge lamp easily goes out at the polarity switching time after the discharge lamp is lighted are prevented, so that stable lighting can be guaranteed.

What is claimed is:

1. A discharge lamp lighting circuit to light a plurality of discharge lamps, comprising:

a starter circuit including a transformer comprising a primary winding and a plurality of secondary windings, one end of each secondary winding being connected to a voltage feed system and the other end of each secondary winding being connected to a discharge lamp;

a primary circuit comprising the primary winding of the transformer, a capacitor and a switch element;

wherein when the switch element conducts, the capacitor is discharged and generated voltage is increased by the transformer, then is applied through each secondary winding to the corresponding discharge lamp.

2. The discharge lamp lighting circuit as claimed in claim 1 wherein winding beginnings or winding terminations of all secondary windings involved in the transformer are defined as connection terminal sides to the discharge lamps.

3. The discharge lamp lighting circuit as claimed in claim 1 wherein said plurality of discharge lamps are used as light sources of a high beam and a low beam respectively.

4. The discharge lamp lighting circuit as claimed in claim 1 wherein said plurality of discharge lamps are used as light sources of front lights placed on the left and right of the front of a vehicle respectively.

5. The discharge lamp lighting circuit as claimed in claim 1, wherein said voltage feed system comprises:

a power supply;

a DC power supply circuit coupled to the power supply; and a DC-AC conversion circuit coupled to the DC power supply;

wherein the DC-AC conversion circuit is coupled to the discharge lamp.

6. A starter circuit of a discharge lamp lighting circuit to start a plurality of discharge lamps, comprising:

a transformer comprising a primary winding and a plurality of secondary windings, one end of each secondary winding being connected to a voltage feed system and the other end of each secondary winding being connected to a discharge lamp;

a primary circuit connected to the primary winding of the transformer, including a capacitor connected to a d.c. power supply and a switch element;

wherein when the switch element conducts, the capacitor is discharged and generated voltage at this time is increased by the transformer, then is applied through each secondary winding to the corresponding discharge lamp.

7. The starter circuit as claimed in claim 6 wherein said plurality of discharge lamps are used as light sources of a high beam and a low beam respectively.

8. The starter circuit as claimed in claim 6 wherein said plurality of discharge lamps are used as light sources of front lights placed on the left and right of the front of a vehicle respectively.

9. The starter circuit as claimed in claim 6 wherein winding beginnings or winding terminations of all secondary windings involved in the transformer are defined as connection terminal sides to the discharge lamps.

* * * * *